United States Patent [19]

Davis, Jr.

[11] Patent Number: 4,938,484

[45] Date of Patent: Jul. 3, 1990

[54] GAME DEVICE AND SYSTEM

[76] Inventor: Charles S. Davis, Jr., 134 Lakeshore Dr., No. 516ON, North Palm Beach, Fla. 33408

[21] Appl. No.: 271,493

[22] Filed: Nov. 14, 1988

[51] Int. Cl.[5] ..... A63B 65/12

[52] U.S. Cl. ..... 273/324

[58] Field of Search ..... 273/323, 324, 325, 326, 273/317, 318

[56] References Cited

U.S. PATENT DOCUMENTS

| | | | |
|---|---|---|---|
| 1,551,459 | 8/1925 | Blakoe | 272/137 |
| 1,989,184 | 1/1935 | Maryfield et al. | 273/402 |
| 2,835,494 | 5/1958 | Hull | 273/324 |
| 3,342,491 | 9/1967 | Padovani | 273/324 |
| 4,234,183 | 11/1980 | Stephens | 273/318 |

*Primary Examiner*—William H. Grieb

*Attorney, Agent, or Firm*—Malin, Haley, McHale, DiMaggio & Crosby

[57] ABSTRACT

A game ball engaging and manipulating device including frame bar members, sling and connecting means. The sling includes a generally rectangular fabric section having its long sides connected to elastic cord. The frame bar members are connected to both the short side of the fabric section. The frame members each consist of a cylindrical bar made of wood or other suitable material. One end of each bar is attached to the sling. The sling is connected to the bar so that the bars rotate independently in relation to the sling. The sling includes a pocket portion in the middle of the sling. The opposite end of each bar possesses a molded handle to allow ease and comfort of gripping and using the device. The game ball engaging and manipulating device is held by the user with one hand gripping each handle and the ball is manipulated, catapulted, snapped forward and engaged in a pocket formed in the sling.

9 Claims, 3 Drawing Sheets

GAME DEVICE AND SYSTEM

BACKGROUND OF THE INVENTION

1. Field of the Invention

The field of the invention is in the general area of scholastic physical education and the development of game sports The instant invention relates to a game device and associated game system that may be used on a playing field, court or gymnasium floor, for the immediate purpose of scoring points but with the ultimate objective of body development and consequently improving health. The invention further relates more specifically to an apparatus for catching, holding, cradling and subsequently projecting a non-inflated game ball. The structure of the game ball manipulating device allows for great maneuverability by a user and employs both hands equally.

The game system of the instant invention employs a two handed, ball manipulating apparatus of such a design as to allow the ball to be launched and retrieved from any and all arm positions such as forehanded, backhanded, underhanded or overhanded. The user grasps hand grips positioned one each at the bottom extremity of the sling bars, well below all of the sling-to-bar attachments positioned at the opposite, or upper, end of said sling bars.

The game system develops ambidexterity, eye to hands coordination, and therefore requires a ball hurling and retrieving apparatus which is non-complex, yet highly versatile, and capable of scooping the ball from the ground without releasing the hands from the handle grips. It also requires a sling device capable of hurling the ball fairly accurately to considerable distances.

2. Description of the Prior Art

In the past, slings have been employed as weapons to hurl solid objects. These were generally single handed double sided thongs which were whirled around the head with one side subsequently released. Forked sticks held in one hand while employing the other hand to draw an elastic band were commonplace boyhood possessions of yesteryear.

Relatively little attention seems to have been given to game devices or systems involving two-handed sport slings. Various game devices and systems involving balls that are pushed, struck, kicked, batted or simply thrown by hand have received most attention and are plentiful.

Our review of the more recent prior art in the design of sport slings have located several U.S. Patents, namely U.S. Pat. No. 4,234,183, issued 11/1980 to Stephen and the patents cited therein, namely U.S. Pats. No. 1,551,459 issued 8/1925 to Blakoe, Class 272/137, 1,989,184 issued 1/1935 to Maryfield et al., Class 273/95 R, and 3,342,491 issued 9/1967 to Padovani, Class 273/96 R.

An examination of the prior art cited in U.S. Pat. No. 4,234,183 reveals that in all cases the sling material is attached to the handles in such a manner that the operator's handgrips are positioned substantially in line with the mesh material when pulled out flat so as to propel the ball. Without the benefit of any extended leverage beyond arms length, the flight of the ball is thereby limited as to velocity and distance.

Again, the above cited prior art does not reveal any means for attaching the holding, catching, cradling and projecting portion of a game ball throwing apparatus to elongated bars that permit rotation of the bars around their long axis through an arc of 360 degrees. The omission of this means for attaching in the prior art impedes the full freedom of use of the sling apparatus such as is achieved in the use of a tennis racket in the game of tennis wherein the racket handle is rotatable in the hands.

Again, the above cited prior art does not reveal the use of restraining shock cords affixed to rings which rings are attached at their opposite ends to elongated bars and which rings further allow for free rotation thereof relative to said bars. This omission of the restraining elastic cords precludes the use of a sling apparatus which can scoop the ball up from the ground or properly cradle the ball during play.

In the Stephens patent, recognition is given of the need to "cradle" or center the ball in the sling for accuracy in hurling. To accomplish this "centering", an open hole of smaller diameter than the ball is provided in the center of the sling mesh but this Stephens design feature does not provide a cradle "lip" which enables the ball to remain cradled or to be rapidly scooped up off the ground during the "heat" of play.

To summarize, the prior art does not reveal means of, first, extended leverage of the hurling apparatus beyond arms length, second, for properly rotating the sling around the sling handlebars or vice versa (to prevent twisting or wrapping of the sling relative to the bars) and, third, properly scoop and cradle the ball during violent and rapid movements.

Due largely to the above omissions and limitations, the prior art in the field of sport sling inventions does not appear to have disclosed either a game system or a non-complex, easily assembled, game ball sling design qualifying for use in seriously competitive team sports games.

SUMMARY OF THE INvENTION

A game ball engaging and manipulating device and related system is disclosed herein including frame bar members, sling pad assembly and connecting means. The sling pad assembly includes a generally rectangular fabric section of mesh, woven net or similar material folded over double to form sleeves or loops at the sides and other sleeves or loops at the ends and sturdily hem stitched together. The sling pad assembly is connected on the longer sides by elastic means, such as elastic tape or shock cords inserted in the resulting sleeves or loops that make up part of the connecting means, and on the shorter sides by other sleeves which are connected by inserting the frame bar members into said other sleeves. The elastic means are close looped at the ends and slightly shorter in unstretched length than the rectangular portion of the fabric. The frame bar members are thus attached to both the fabric section and the elastic means by said looped connecting means. The frame bar members each consist of a cylindrical bar. One end (the upper end) of each bar is attached to the sling pad assembly by the connecting means that allow rotation of said looped bars without wrapping the sling around the bars. The connecting means also includes means for limiting movement of the sling pad along the elongated axis of each bar.

The opposite or lower end of each bar has associated therewith a molded handle to allow a player to easily grip and use the device. The game ball engaging and manipulating device is held by the user with one hand gripping each handle and the ball is engaged and manipulated in the cradling pocket formed by the unstretched elastic cords when the bars are brought into closely spaced parallel relationship.

The location of the hand grips at one end of the bars and the sling pad at the opposite end provide additional leverage to the user and consequently greater hurling speed and distances. A snap action achieving a fully stretched flat sling pad is accomplished by rapidly moving the frame bars forward in the direction aimed and outward or apart from each other at the precise time to obtain proper directional control.

The frame members have handles for use by both hands. The use of both hands and arms by a user develops ambidexterous hand to eye coordination and promotes muscle development on both sides of the body equally.

The instant invention of sport slings and associated game systems disclosed herein would appear to be a desirable contribution to the art of physical exercise and therefore to future physical education curricula.

It is an object of this invention to provide a noncomplex but versatile game ball engaging and manipulating device including extended cylindrical framing handlebars, pliable but sturdy sling pad border members sewn to a generally rectangular fabric/mesh sling section in which the hurling handles are at one end of the bars and the sling pad and sling pad border members are rotatably attached at the other end.

It is also an object of this invention to provide a game ball handling device containing the above components having suitable connecting means including elastic cords inserted in multiple scalloped border member sleeves along the longer sides of said sling pad and pliable border member fabric loops on the shorter sides of said sling pad in which the end loops of each are slipped over the framing bars with tolerances allowing for freedom of movement.

A further object of this invention is to provide a sturdily sewn rectangular fabric sling pad assembly rotatably connected to extended framing handlebars by connecting means which allow free rotation of said bars relative to said sling pad assembly, said sling pad assembly being supported by elastic cords slightly shorter in unstretched length than the long side of the fabric sling pad assembly.

An additional object of this invention is to provide a game ball handling device including a generally rectangular pliable fabric sling section, sleeved border means, inserted upper and lower border elastic connecting means, fabric section attachment means, inserted cylindrical handlebar framing means, including flanged retaining rings fixedly attached to the framing bars with the sole purpose of limiting movement along the elongated axis of the framing bars of the sling pad attachment means and elastic cord attachment means.

In accordance with these and other objects which will be apparent hereinafter, the instant invention will now be described with particular reference to the accompanying drawings.

DESCRIPTION OF THE PREFERRED EMBODIMENT

Figure 1:
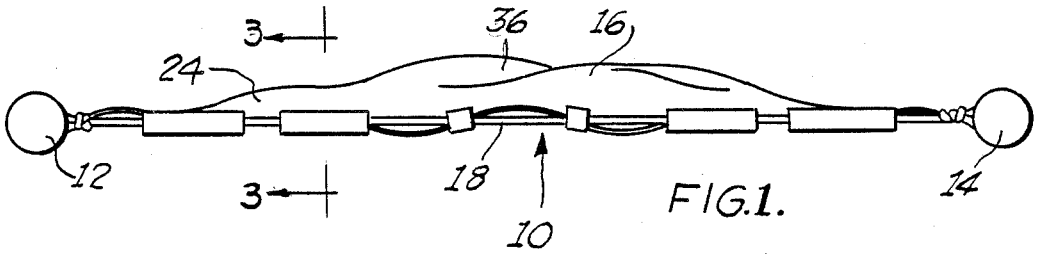
FIG. 1 is a top view of the sling device with bars 12 and 14 shown in parallel position but with elastic cords 18 and 22 shown in the unstretched position.
Figure 2:
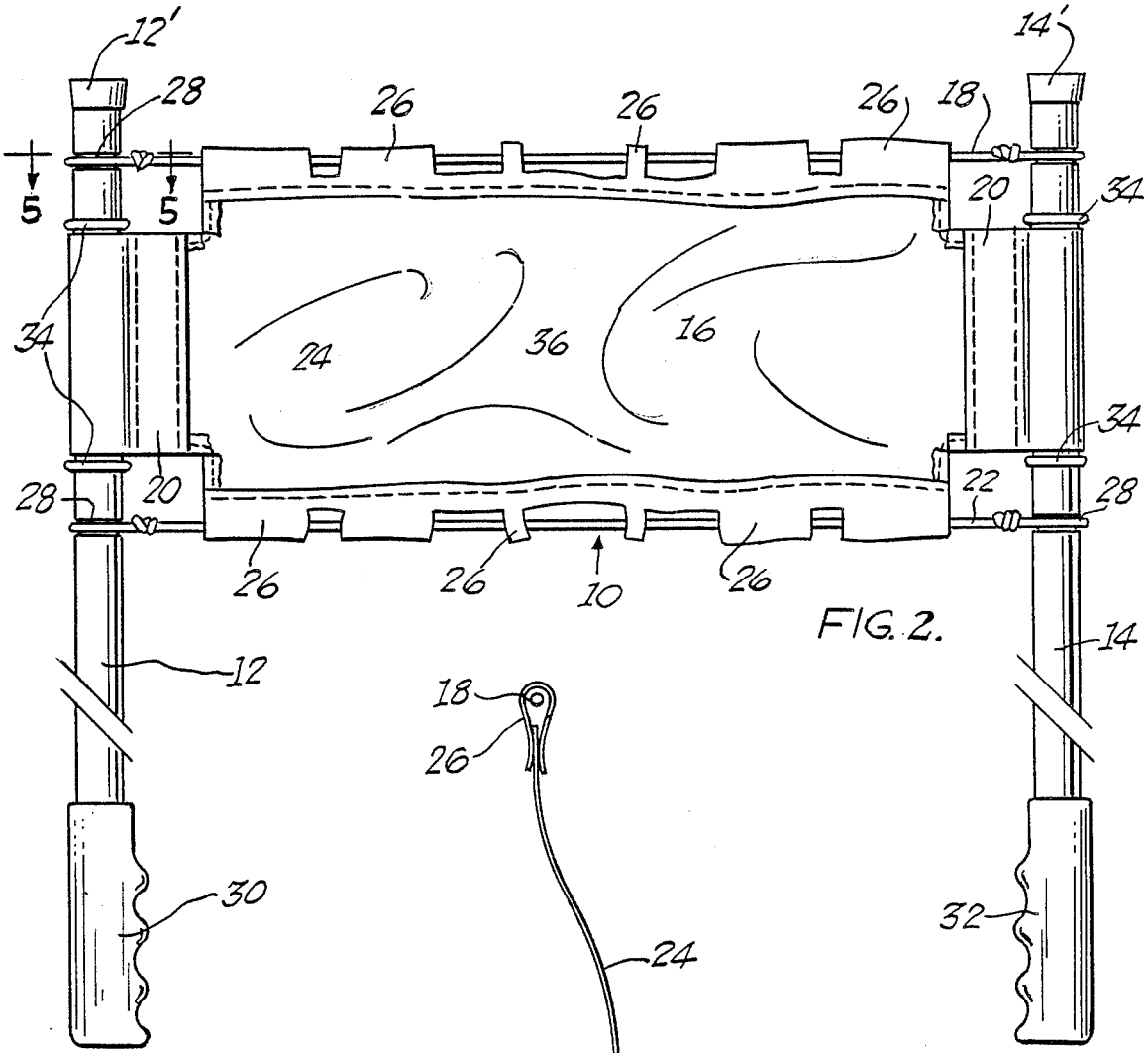
FIG. 2 is a front view of the sling device in the same unstretched position with the bars partially cut away.
Figure 3:
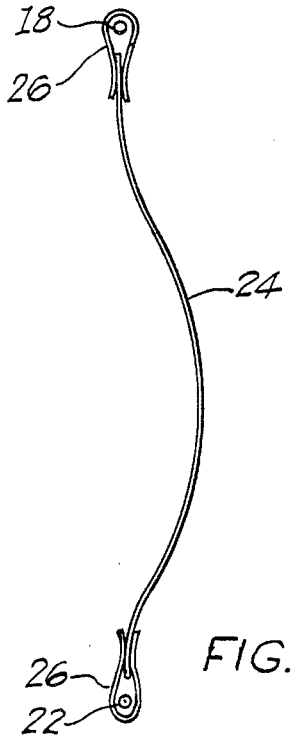
FIG. 3 is an end view through section 3—3 of FIG. 1 illustrating the inserted elastic cord connection.

This invention relates to a game system that may be used in team competition playing in any sufficient area by any number of players from four to twenty. The game system includes a ball engaging and manipulating sling device 10 shown in FIGS. 1, 2, 6 and 7. Referring to FIGS. 1 and 2, the sling device includes frame bar members 12 and 14, a sling pad assembly 16 (assembled by stretching) containing net section 24 and border means 20 and 26, and connecting means 18 and 22.

Figure 4:
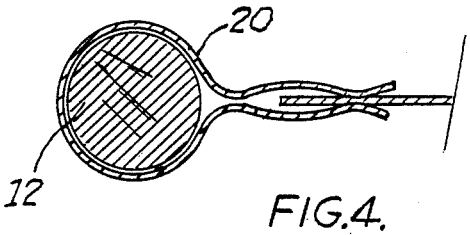
FIG. 4 is a top illustration showing the non-elastic sling pad sleeved border connection.

Referring to FIG. 4, the sleeves 20 are also connecting means but are part of the sewn sling pad assembly 16.

Figure 5:
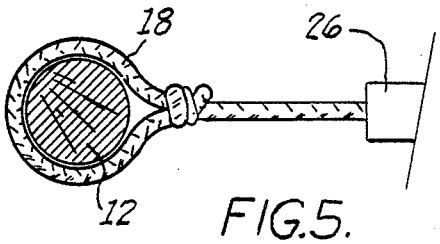
FIG. 5 is a top illustration showing the looped end elastic cord connection.
Figure 6:
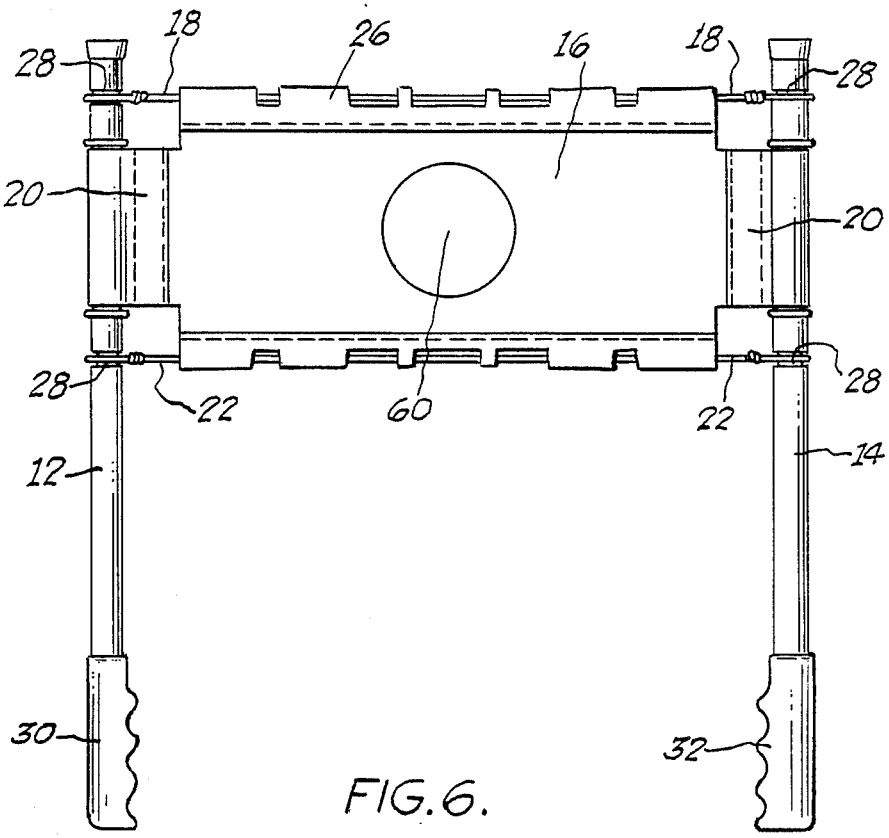
FIG. 6 is a front view of the device similar to FIG. 2 but with elastic cords 18 and 22 in the stretched modes and the sling pad assembly in the flat position for hurling.

Again referring to FIG. 2 the sling pad assembly 16 includes a generally rectangular net fabric section bordered on the longer sides by notched, folded and hem stitched reinforcing fabric sleeves 26 which accommodate inserted elastic connecting means 18 and 22, and bordered on the shorter sides by folded and stitched reinforcing fabric sleeves 20. The fabric sleeves 20 are connected to the frame members 12 and 14 as shown in FIGS. 1 and 4. Referring to FIGS. 5 and 6, the elastic shock cords 18 and 22 are comprised of closed loops at their ends and are slightly shorter in unstretched length than the sling pad assembly 16. Thus the frame members 12 and 14 are attached to the sling pad 16 not only by their insertion into border member sleeves 20 but also by insertion into the closed loops of the elastic cords 18 and 22 at grooved channels 28.

Referring to FIG. 2 again, the frame members 12 and 14 each consist of a cylindrical bar made of wood or other suitable material having end caps 12' and 14' at one end and handles 30 and 32 at the other end. The sling pad attachments are positioned on the frame members at the capped end of the bars along the longer axis of each bar by a suitable limiting means such as by notches 28 in the bar itself or by fixed retaining rings 34 fixed to the bars 12 and 14 which restrain travel.

The fabric section 24 may be provided with a pocket 36 that bulges out as shown in FIG. 1.

Figure 7:
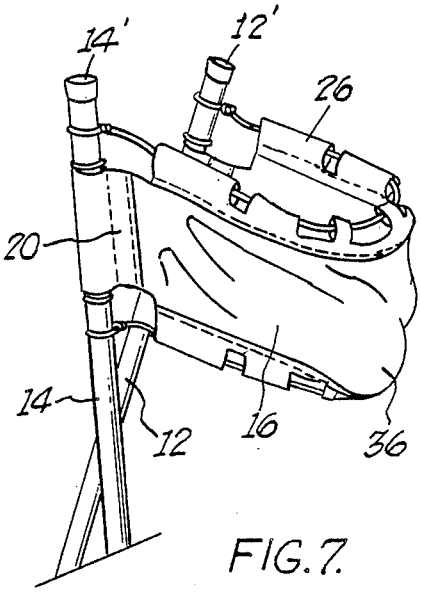
FIG. 7 is an illustration of the sling device in the folded catching and cradling position before the sling is snapped into the stretched (hurling) position shown in FIG. 6.

Referring particularly to FIG. 7 which illustrates the ball catching position, when the sling bars 12 and 14 are not fully separated, the elastic cords 18 and 22 contract to their unstretched length resulting in imparting a compound curved or cradled shape to the sling pad assembly 16. This is entirely due to the difference in length between the pad assembly 16 and the elastic cords 18 and 22 and is highly desirable because this feature enables the user to readily retrieve a game ball whether on the ground or in the air and re-position it for accurate hurling without having the ball roll out of the sling.

Referring now to FIG. 6, when the frame bars 12 and 14 are "snapped" apart (being restrained only by pad assembly 16) to expel the game ball 60, the pad 16 assumes a taut and flat shape momentarily imparting a powerful propulsion force to the ball and allowing the user to exercise greater control of the direction of flight of the ball.

Normally, the game ball handling device 10 is held by the user with one hand gripping each of the handles 30 and 32 for either receiving, cradling or hurling the ball. The distance of the handle from the sling pad assembly provides more leverage and consequently greater power and greater distance to be achieved in both hurling and retrieving.

Finally, referring to FIGS. 2, 4 and 5, the said connecting means 20 between the bars 12 and 14 and the pad assembly 16 includes the loop and sleeve configurations shown and described herein as well as said retaining channels 28 and rings 34, and allows each of the bars to rotate a full 360 degrees or more in either direction, clockwise or counter clockwise, without wrapping said sling pad assembly around or onto either bar 12 or 14.

Figure 8:
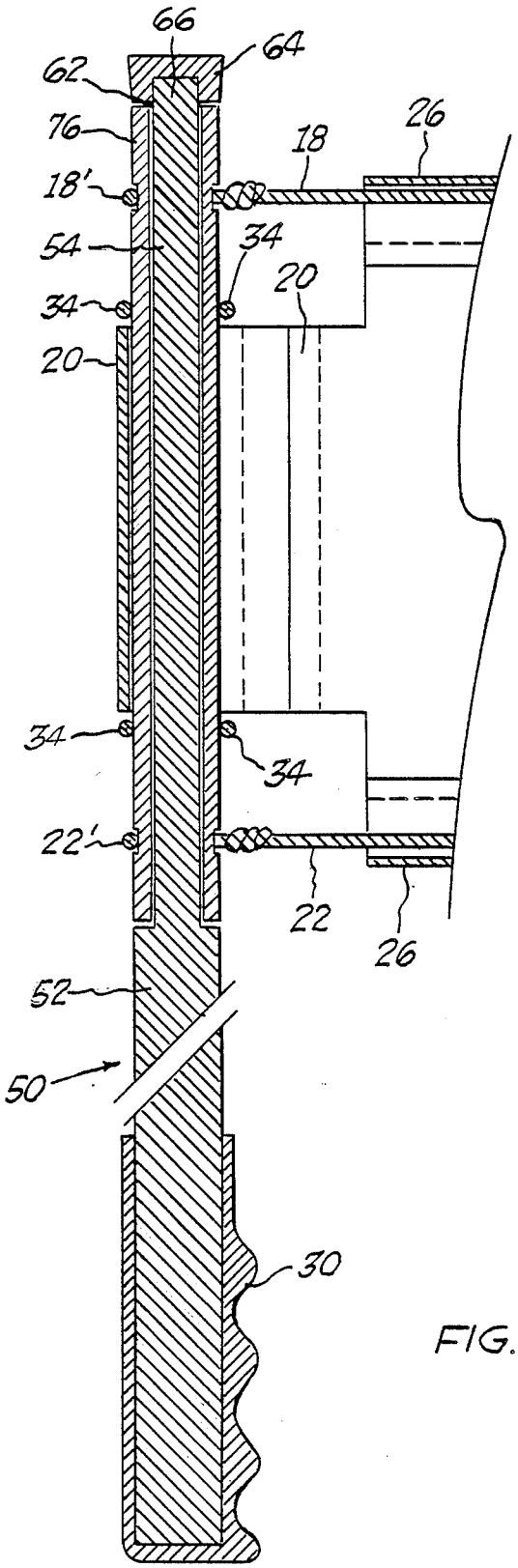
FIG. 8 is another configuration of the device with nonrotating sling pad attachments.

Another configuration means of attaching the sling pad assembly to the frame members is shown in FIG. 8. In this instance, the frame member 50 is an assembly and has 4 parts: handle bar with upper and lower sections 42 and 54, hand grip 30, tubular rotating frame member 76, and retaining cap 64.

The handle bar may have on specific diameter in its lower part at 52 which may be of hexagonal cross section and a lesser diameter in its upper part at 54 which may be of round cross section. The lower end portion of frame member assembly 50 may be wrapped with leather, tape or other hand gripping material as shown at 30. This material may absorb perspiration. The frame member assembly 50 may replace frame members 12 and 14 as shown in drawings 1 and 2.

The tubular rotating member 76, shown in FIG. 8, allows the sling pad assembly 20 to be fixedly attached to rotating tube 76 along with elastic cords 18' and 22'. The round end portion of the handle bar 54 is inserted into tubular rotating member 76 until seated on the flange 62 and is slightly longer than tube 76 which allows end cap 64 to retain tube 76 in place.

The game system disclosed herein (and associated with the game ball manipulating and handling device disclosed herein) constitutes an entirely new athletic sport. It is played with a non-inflated preferably sponge rubber ball 2 ½ inches in diameter. The frame members may be 18 inches long by ⅞ inches in diameter. The sling pad assembly may be 6 inches by 18 inches. The game is played in a variety of ways, one version being a court game with 2 or 3 players each side playing across an elevated net as in volleyball.

Another version is a field game requiring two teams of six or more players each attacking and defending elevated circular vertical baskets 4 feet in diameter at each end of the field. In this version the players are constantly running and passing the ball to each other in an attempt to reach a position from which they can hurl the ball through the goal. Passes are sometimes incomplete, grounding the ball. In such case the players must be able to compete for recovery of the ball by scooping it up from the ground.

The hardware may take various shapes. The ball may be a sponge rubber ball used in the Canadian National Game of La Crosse, two frame members may be approximately 20 inches long by ⅞ inches in diameter. The sling may be approximately 6 inches in height and 20 inches in length. The player may pick the ball up off the ground with the sling and properly cradle it before releasing the ball.

The game may be a court game played with only two, or three persons on a side. The doubles game is played on the regulation tennis court. However, a net is preferred. Alleys are used as in doubles tennis. In the net game, the ball should NOT touch the ground during play, a point is scored when the ball touches the ground within its court during play or the ball is outside the court boundaries. Up to two on-side passes per volley may be made by each team during play before returning the ball over the net. A player can be in possession of the ball no more than three steps or four seconds at a time. A serve is made behind the base line to the opponents court. Five points wins a game. Five games may make up a set. The first two out of three sets wins the entire game.

The triples games require three players on each side. The game is played on a larger court such as 120 feet in length by 56 feet in width. A spiking line parallel to the base line may be provided at midpoint between the net and the baseline. The team player forward may not receive or return a ball behind his spiking line. A second member may play back and may not receive or return a ball forward of his spiking line. The third member plays the ball on either side of the spiking line. Members may rotate positions for each individual game.

The goal-to-go is played on a regulation football field. A team may consist of eight players. The object is to accumulate a number of "goals" during the allotted time. A goal consists of slinging the ball through a netted hoop or hole on a backboard which is elevated to a center height of approximately 11 feet. The target hole may be 48 inches in diameter. The backboard may be ten feet square.

Team members play positions. Four play attack positions and four play defensive positions. The field may be divided into "position sections" bounded by lines of which are the outside boundaries. There may be sidelines and goal lines. Additional lines may divide the field into four equal latitudinal sections. The remaining three may be parallel to the sidelines and divide the field into four equal longitudinal sections. Team positions, left to right, may be as follows:

ATTACK: left wing, left center, right center, right wing.

DEFENSE: left wing, left center, right center, right wing.

Players are responsible for any action resulting in a score from his position section.

RESTRICTIONS TO PLAY:

1. The ball may be possessed for only five seconds.
2. Only four steps may be taken while in possession of the ball.
3. A backboard rebound is still in play.
4. After an out-of-bounds ball, possession of the ball goes to the opposing side.
5. The duration of playing time may be 40 to 50 minutes.

The instant invention has been shown and described herein in what it is considered to be the most practical and preferred embodiment. It is recognized, however, that departures may be made therefrom within the scope of the invention and that obvious modifications will occur to a person skilled in the art.

I claim:

1. A sling device comprising:

two long bars, each of said bars having a first end portion and a second end portion;

a sling having a body with four sides, said sling positioned between and rotatably connected to each said first end portion;

a handle connected to each said second end portion; and said sling including elastic means connected thereto and rotatably connected to each said first end portion.

2. A sling device comprising:

two long bars, each said bar having a first end portion and a second end portion;

a sling having a body with four sides, said sling positioned between and having two opposite sides each connected to one of said first end portions;

a handle connected to said second end portion; and sling connecting means for rotatably connecting each of said two opposite sides to each said bar and elastic means rotatably connected to each said bar, said elastic means connected to two other sides of said sling spanning between said bar.

3. A sling device as set forth in claim 2, wherein:

said two opposite sides of said sling are directly and rotatably connect to said bars;

said sling including elastic means for retaining a ball centrally in said sling.

4. A sling device as set forth in claim 2, wherein:

said two opposite sides rotatably connect by sleeve portions to said bars;

said other sides movably connect to said elastic means.

5. A sling device as set forth in claim 4, wherein:

said bars having upper ends positioned in line with the uppermost of said two other sides.

6. A sling device as set forth in claim 4, wherein:

said handles have a generally round cylindrical configuration.

7. A sling device as set forth in claim 1 including a rotating member connected between said sling and said first end portion, said rotating member rotatably connected to said first end portion and fixed to said sling.

8. A method of sling pocketing and slinging a ball with a sling device comprising the steps of:

grasping one long bar in each hand, each of said bars having a first end portion and a second end portion;

said grasping being of said second end portion of each said bar;

placing a sling having a body with four sides in the path of a ball, opposite sides of said sling connected by rotatable connecting means to each of said first end portion of said bars including elastic means connecting thereto providing a pocket portion generally located centrally in said sling;

said sling positioned in a non-stretched configuration between and rotatably connected one side to each said first end portion;

pocketing said ball in said non-stretched pocket portion of said sling, and repositioning said sling device for slinging said ball, moving said bars apart from one another quickly to snap said ball out of said sling.

9. A sling device as set forth in claim 2, wherein:

each of two said elastic means is slightly shorter in unstretched length than each of two other longer sides of said sling.

* * * * *